United States Patent [19]

Edgar

[11] 4,405,850

[45] Sep. 20, 1983

[54] COMBINATION MICROWAVE HEATING APPARATUS

[75] Inventor: Richard H. Edgar, Chelmsford, Mass.

[73] Assignee: Raytheon Company, Lexington, Mass.

[21] Appl. No.: 254,221

[22] Filed: Apr. 15, 1981

Related U.S. Application Data

[63] Continuation of Ser. No. 103,262, Dec. 13, 1979, abandoned, which is a continuation of Ser. No. 949,294, Oct. 6, 1978, abandoned.

[51] Int. Cl.[3] ..... H05B 6/78

[52] U.S. Cl. ..... 219/10.55 A; 219/10.55 R; 219/400; 34/1

[58] Field of Search ..... 219/10.55 A, 10.55 R, 219/10.55 M, 10.55 E, 10.55 F, 400, 388, 390; 34/1; 432/247, 143, 144, 148, 201, 202, 203

[56] References Cited

U.S. PATENT DOCUMENTS

| | | | |
|---|---|---|---|
| 1,517,820 | 12/1924 | Bone | 432/247 |
| 2,738,406 | 3/1956 | Zaleski | 219/10.55 R |
| 3,409,447 | 11/1968 | Jeppson | 219/10.55 A |
| 3,585,258 | 6/1971 | Levinson | 219/10.55 E |
| 3,731,037 | 5/1973 | Levinson | 219/10.55 E |
| 3,870,462 | 3/1975 | Semenov et al. | 432/144 X |
| 3,884,213 | 5/1975 | Smith | 219/400 X |
| 3,909,574 | 9/1975 | Muller et al. | 219/10.55 A |
| 4,028,520 | 6/1977 | Torrey | 219/10.55 B |
| 4,045,638 | 8/1977 | Chiang et al. | 219/10.55 A |
| 4,140,887 | 2/1979 | Sutton et al. | 219/10.55 E |
| 4,198,554 | 4/1980 | Wayne | 219/10.55 A |
| 4,221,680 | 9/1980 | Hardwick et al. | 219/10.55 A X |

FOREIGN PATENT DOCUMENTS

| | | | |
|---|---|---|---|
| 1947738 | 7/1978 | Fed. Rep. of Germany | 10.55 F/ |

*Primary Examiner*—B. A. Reynolds
*Assistant Examiner*—Philip H. Leung
*Attorney, Agent, or Firm*—William R. Clark; Joseph D. Pannone

[57] ABSTRACT

A microwave heating apparatus wherein thermal insulation material positioned inside the enclosure defines the processing cavity. The temperature in the cavity may be raised by, for example, hot air directed into it so that product may be processed by the combination of microwave energy and hot air. For particular applications, the hot air substantially compensates for product surface radiation, thereby providing a more uniform product temperature profile.

4 Claims, 4 Drawing Figures

COMBINATION MICROWAVE HEATING APPARATUS

CROSS-REFERENCE TO RELATED CASES

This is a continuation of application Ser. No. 103,262, filed Dec. 13, 1979, which is a continuation of application Ser. No. 949,294, filed Oct. 6, 1978 (now both abandoned).

CROSS-REFERENCE TO RELATED APPLICATIONS

Application Ser. No. 906,293 by Wesley W. Teich et al. filed May 15, 1978, now abandoned and assigned to the same assignee hereof is hereby incorporated by reference and made a part of this disclosure.

BACKGROUND OF THE INVENTION

For many years, microwave energy has been used for domestic cooking and processing of materials in industry. The advantages of heating with microwave energy have been well documented. One such advantage has been that less insulation is generally required around the heating cavity because the rise in temperature in a microwave cavity is substantially caused only by air cooling the magnetron and radiation from the heating body. For example, typical temperatures in a domestic microwave cooking oven range from 100° to 150° F. Even in industrial microwave applications, interior cavity temperatures, which are a function of the application, are frequently below 150° F. With conventional domestic ovens utilizing gas or electric power, cooking temperatures commonly range from 200° to 500° F. with higher temperatures for broiling.

For some industrial microwave processing applications, it has been found to be desirable to provide a hot air blanket around the surfaces of the processing material. For example, in a conveyorized microwave system for vulcanizing rubber, a surface temperature in the range from approximately 170° to 500° F. is important to compensate for the surface heat lost by radiation. The hot air blanket helps provide for uniform curing through the rubber profile.

Accordingly, the apparatus should provide both microwave heating and hot air in the processing cavity. Including both of these heating means in a single cavity without violating any of the basic disciplines associated with each technology has resulted in excessive apparatus cost. Present methods commonly utilize an inner conductive enclosure to contain the microwave energy surrounded by layers of a standard glass insulation and a protective outer casing.

SUMMARY OF THE INVENTION

The invention discloses a conductive enclosure energized with microwave energy and having thermally insulated material supported adjacent to an inside wall thermally insulating the interior therein defined from said wall. The term microwave is defined to be electromagnetic wave energy having a free space wavelength in the range from one millimeter to one meter. The electrically conductive enclosure functions to contain the microwave energy in a region where a body is to be processed. Preferably, the insulating material is substantially transparent to microwave energy and exhibits low loss propagation properties for microwave energy.

More specifically, the insulating material may comprise refractory firebrick or glass foam.

The invention herein defined has particular advantage in microwave processing systems which include an auxiliary means for raising the temperature such as directing hot air into the cavity. It may also be preferable that the thermally insulating material define a tunnel cavity within the conductive enclosure through which a movable means such as a conveyor belt carries product to be processed by the combination of microwave heating and hot air.

BRIEF DESCRIPTION OF THE DRAWINGS

The foregoing and other objects and advantages will be understood more fully in the following detailed description thereof with reference to the accompanying drawings wherein.

DESCRIPTION OF THE PREFERRED EMBODIMENT

Figure 1:
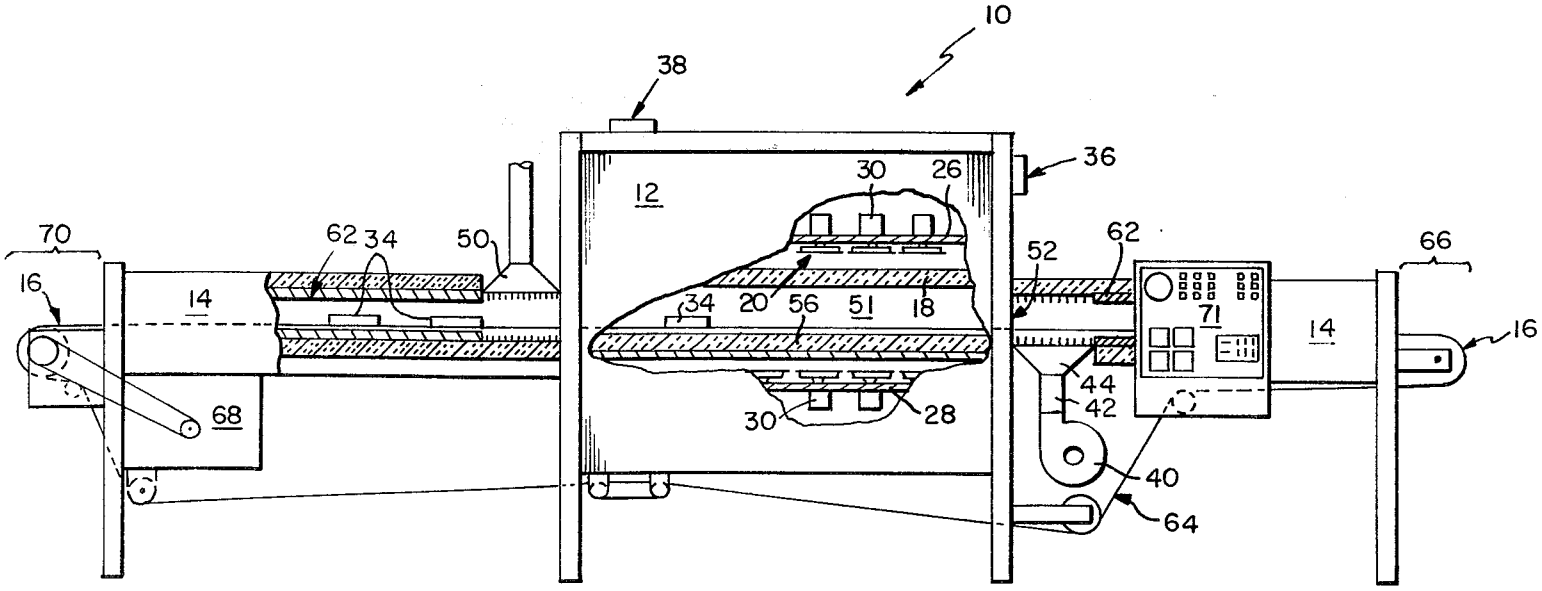
FIG. 1 is a partially sectioned side elevation showing the oven, hollow structures at both ends of it, and means to move the product through the processing region.

Referring to FIG. 1 there is shown a microwave heating apparatus 10 comprising an oven section 12 where the processing is performed, hollow structures 14 at both ends of the oven to prevent the leakage of microwave energy, and a means 16 for moving product through the oven.

The oven section has an enclosure 18 fabricated of a conductive material such as aluminum to contain the microwave energy in the processing region. Although microwave energy may be introduced into the enclosure by any means, it is preferable to use a plurality of microwave energy feed structures 20 each comprising a flat member 22 having slots 23 therein and a dish 24. In the preferred embodiment, eight feed structures are mounted on the upper wall 26 and floor 28 of the enclosure. Each feed structure is crimped to the enclosure surface to prevent the leakage of microwave energy from the enclosure. Although microwave energy may be coupled into each feed structure by any means, it is preferable to bolt a magnetron 30 on the exterior of the enclosure adjacent to each feed structure and insert the radiating probe 32 of each magnetron through a hole (not shown) in the enclosure wall directly into each respective feed structure. The dish in combination with the flat member provides a waveguide type structure to transmit the microwave energy from the center axis of the feed structure out to the slots from which the energy is radiated into the enclosure. It is preferable that a feed structure transmits energy as a directive antenna rather than merely provide a coupling device to set up standing waves within the enclosure. More specifically, it is preferable that a substantial part of the transmitted energy is radiated to the region of the enclosure through which the product 34 moves without reflecting from the walls of the enclosure. This directivity in combination with a selective rotational orientation scheme for the feed structures results in heating uniformity within the product without the expense and maintenance of a mode stirring device. Furthermore, a selective feed structure rotational scheme in combination with supplying adjacent magnetrons with different AC phases of a three-phase source substantially prevents locking of adjacent magnetrons.

The magnetrons are a conventional type known in the art and preferably oscillate at 2450 megacycles. An air intake port 36, exhaust port 38, and ducts (not shown) are provided for circulating air past the magnetrons and respective power supplies for cooling.

Figure 2:
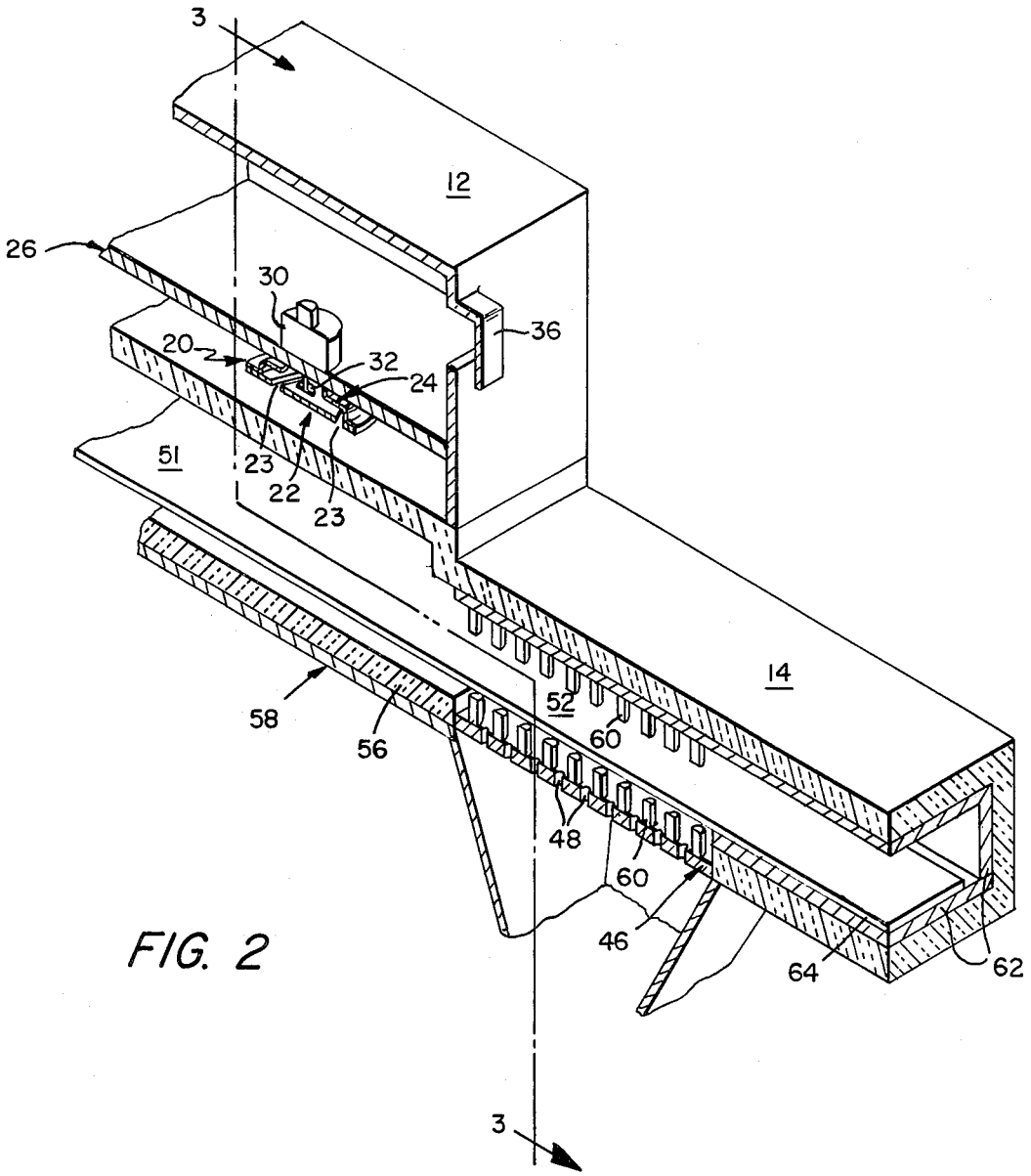
FIG. 2 is a sectioned isometric view showing a portion of the input hollow structure, coupling means for coupling hot air into said hollow structure, and the oven.
Figure 3:
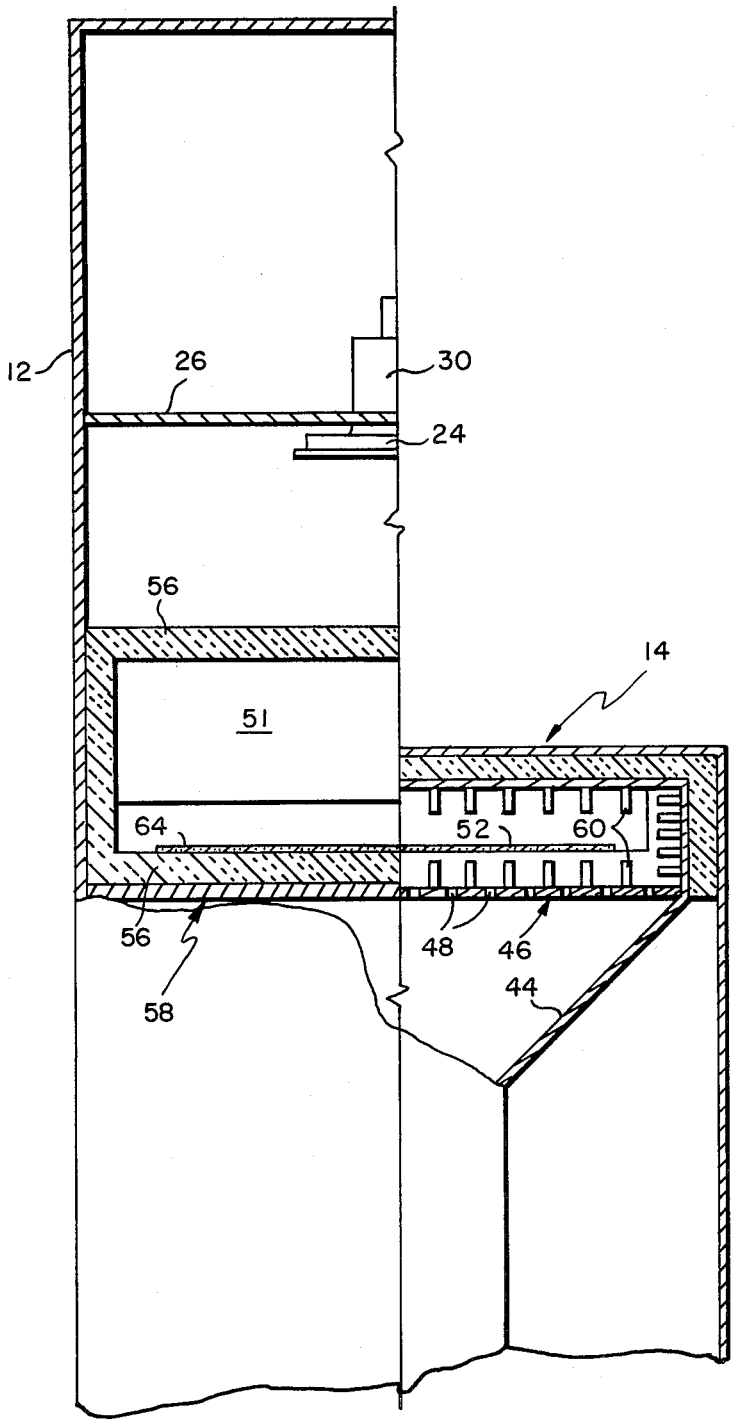
FIG. 3 is an end elevation view of the enclosure and hollow structure taken along line 3—3 of FIG. 2.

Further, referring to FIGS. 1, 2 and 3, air is directed from a blower 40 through a heater 42 where electric coils (not shown) selectively raise the temperature of the ambient air to the range from 170° F. to 500° F. Experience has shown that for the application of vulcanizing extrusions, it is preferable that the blower operate in the range from 40 to 50 cubic feet per minute. A coupling structure 44 directs the flow of hot air from the heater to a conductive plate 46 in the hollow structure at the input end of the enclosure. The plate is provided with a plurality of holes 48 to permit the passage of the hot air into the hollow structure. Other features of the plate are described hereinafter with regard to the hollow structures and their use in the suppression of leakage of microwave energy from the enclosure. An identical conductive plate 48 is provided in the hollow structure at the opposite end of the enclosure where the product exits the enclosure. An exhaust structure 50 is provided at the exterior side of this second mentioned plate to provide an enclosed air path to an exhaust blower (not shown). The exhaust blower functions to create an air pressure in the enclosure which is less than atmospheric so that a substantial percentage of the hot air blown in at the input to the enclosure is drawn into the enclosure rather than escaping down the hollow structure where the product is input. Preferably, means are provided at the output of the exhaust blower to remove the hot air with effluence from the operation area.

While the hot air is within the enclosure, it is substantially confined in a tunnel cavity 51 between the input access opening 52 and the output access opening 54. The tunnel, through the conveyor system transports product, is defined by a top, bottom, and two sides of thermal insulation material 56. As can be seen in FIGS. 1, 2 and 3, the microwave energy is introduced into the conductive enclosure external to the cavity defined by the thermal insulation so that it is preferable that the thermal insulation material be substantially transparent to microwave energy. That is, it is preferable that the thermal insulation material exhibit low loss propagation properties for microwave energy. The preferred embodiment uses a low density refractory firebrick 2300° F. material substantially comprised of silica to accomplish the desirable low loss property. An example of another preferable insulation material is foam glass with low loss constituents. The preferable thickness of the insulation material is a function of the operating temperature in the cavity and the insulation property of the material. In the application of vulcanizing rubber extrusions, the product reaches its vulcanizing temperature in the proximity of the exhaust plate so that a substantial part of the effluence that are given off are exhausted from the processing region without substantial contact with the insulation walls. However, it may be preferable to glaze the inner walls of the insulation so as to make easier the process of periodically cleaning the inner walls.

The thermal insulation may be supported within the enclosure by any one of a number of methods. For example, a platform 58 of a sturdy, low loss material, such as a ceramic, may be supported by brackets (not shown) on the walls of the enclosure and the tunnel of thermal insulation material constructed on top of the platform. Alternatively if the insulation material is rigid enough, it may be supported directly by brackets affixed to the sides of the enclosures. Firebricks may be interconnected by a plurality of means such as, for example, high temperature resistive, low loss cement. The firebricks may also be shaped together or bonded with ties.

For many microwave heating applications such as, for example, vulcanizing rubber extrusions, it is preferable that the extrusions are bathed in a blanket of hot air to compensate for surface radiation of the thermal energy induced by microwave heating. The hot air aides in providing a uniform temperature profile through the extrusion so that proper vulcanizing is accomplished. The apparatus heretofore described provides this desirable combination of microwave heating and hot air. The thermal insulation positioned inside the conductive enclosure provides for energy efficiency by reducing the volume to be heated so that a smaller heater may be used and also, by substantially reducing the amount of heat loss from the apparatus. Furthermore, the construction of the apparatus and the coupling of microwave energy into the enclosure are less complex and hence less expensive than the conventional method of insulating the outside of the conductive enclosure.

Referring to FIGS. 2 and 3, the input hollow structure is shown in detail. In addition to providing a hot air entrance to the enclosure, the hollow structure provides leakage suppression of microwave energy from the apparatus. To increase power efficiency, it is preferable to use a reactive type seal that will reflect rather than absorb microwave energy. In the preferred embodiment, the reactive seal is comprised of a plurality of one-quarter wavelength long cylindrical posts 60 that extend inward from the inner walls and plate 46 of the hollow structure and are arranged in rows to form a "waffle-iron" type pattern. Similar to guide stubs in microwave waveguides, which have been well documented for years, the posts present an equivalent to a series opened circuit for microwave energy propagating down the hollow structure at a particular frequency. In the preferred embodiment, the gap between the ends of the top and bottom posts is approximately two inches. For this embodiment, it has been found that these described reactive seals reduce the leakage of microwave energy to a level that substantially all leakage may be eliminated by using auxiliary absorbing seals 62 that don't require heat removing means such as water circulation.

In operation, the product is placed on a conveyor belt 64 at location 66. The belt is fabricated of low loss fiber glass and is teflon lined to reduce the coefficient of friction of the belt and the surface over which it slides. A teflon lining may be placed over the absorbing material in the hollow structures and the thermal insulation material in the conductive enclosure to further reduce friction. A DC motor 68 at the exit end of the apparatus provides a drive for the conveyor belt. The upper ends of the bottom posts are approximately one-eighth inch below the tensioned path of the conveyor belt to prevent wearing. As can be seen in FIGS. 1, 2 and 3, the belt transporting the product passes over the hot air entering the input hollow structure. This preheating of the belt substantially eliminates it as a heat sink for heat induced in the product by microwave energy during processing. Experience has shown that when the belt is not preheated, the vulcanized rubber may have a tacky region in close proximity to the surface area in contact with the belt. After the product is transported through the input structure, the tunnel cavity defined by the insulation material where it is processed by microwave energy and hot air, and the output hollow structure, it is removed at location 70. The parameters of the processing are controlled by the control panel 71.

Figure 4:
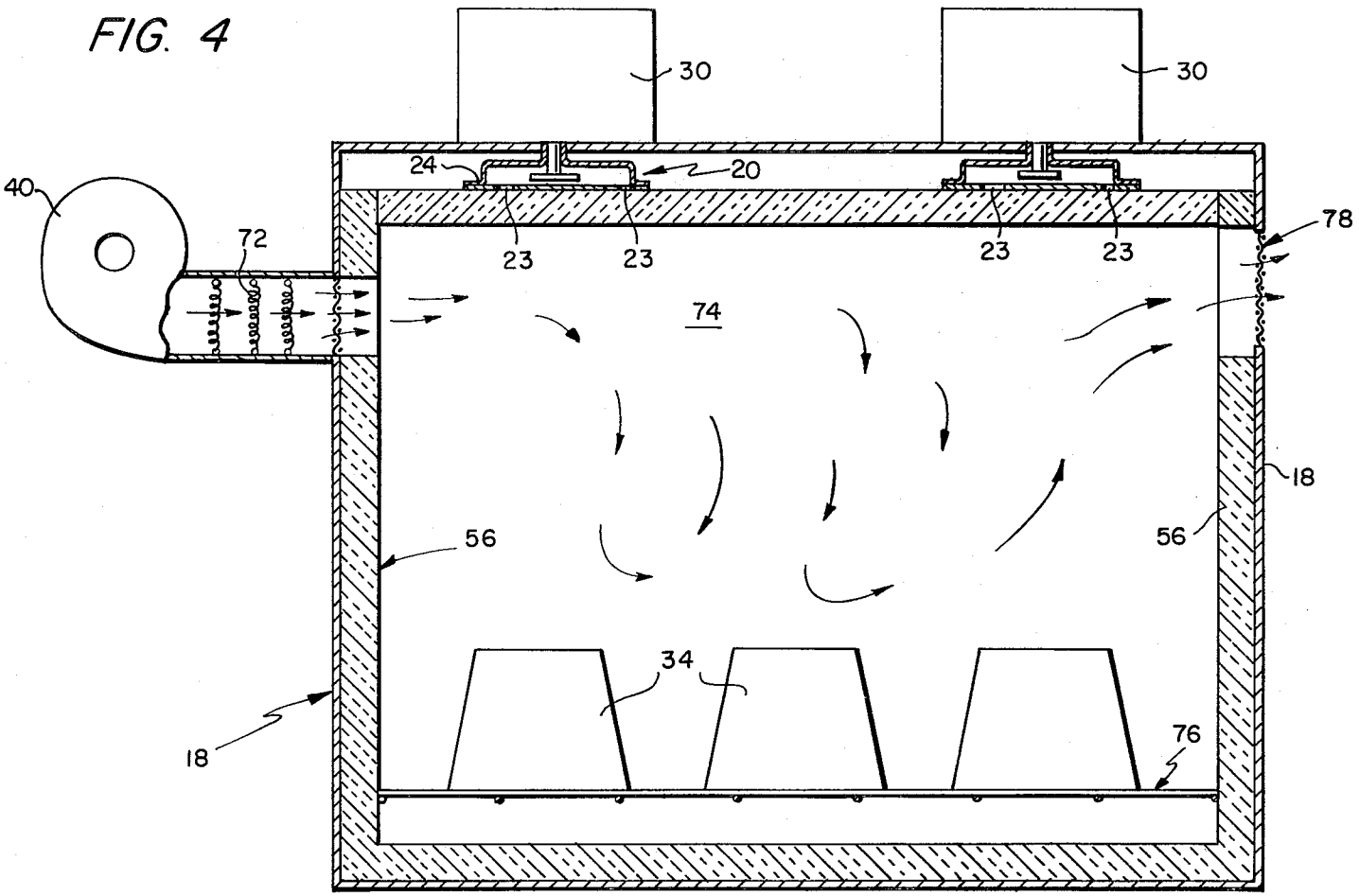
FIG. 4 is a front sectioned view of a batch oven.

Referring to FIG. 4 an alternative embodiment of the invention is shown that can be applied to domestic or industrial batch ovens. Similar to the features described above with reference to the preferred embodiment, a blower forces air across electrical heating coils 72 into a cavity 74 defined by thermal insulation material. The cavity is encased within a conductive enclosure having an exhaust port 78 for removing hot air and effluence from the cavity. A means (not shown) may be provided for cycling the exhausted air back around to the input blower for energy efficiency; preferably such means would also substantially remove the effluence from the hot air. External to the cavity defined by thermal insulation but internal to the conductive enclosure are feed structures from which microwave energy is radiated into the enclosure. It is preferable that magnetrons are coupled into the feed structures as described heretofore. In operation, the product is preferably processed by the combination of microwave heating and hot air by placing it on a support 76 in the cavity through an access means (not shown) such as a door. As previously described, it is preferable that the thermal insulation material is low loss.

The reading of this disclosure by those skilled in the art will lead to various modifications and alterations without departing from the spirit and scope of the invention as defined in the appended claims. It is intended, therefore, that the embodiments shown and described herein be considered as exemplary only and that the scope of the invention be limited only by the appended claims.

What is claimed is:

1. A conveyorized microwave hot air oven, comprising:

a conductive enclosure having entrance and exit openings;

thermally insulating material defining a tunnel from said entrance opening to said exit opening, said material being substantially transparent to microwave energy;

said material being spaced from the walls of said enclosure wherein the volume within said tunnel is substantially less than the volume within said enclosure;

a conveyor system running through said tunnel for transporting objects therethrough;

means for directing heated air under pressure into said tunnel at a first region of said tunnel;

means for exhausting said heated air from a second region of said tunnel; and a directive microwave radiator positioned within said enclosure but outside said tunnel, said radiator radiating microwave energy toward said microwave transparent tunnel, said energy radiating through said microwave transparent material to heat objects passing through said tunnel on said conveyor system.

2. The combination in accordance with claim 1 wherein said insulating material comprises firebrick.

3. The combination in accordance with claim 1 wherein said first region is outside said enclosure adjacent to said entrance opening.

4. The combination in accordance with claim 1 wherein said second region is outside said enclosure adjacent to said exit opening.

* * * * *